US008403052B2

(12) United States Patent
Veit

(10) Patent No.: US 8,403,052 B2
(45) Date of Patent: Mar. 26, 2013

(54) FLOW CONTROL SCREEN ASSEMBLY HAVING REMOTELY DISABLED REVERSE FLOW CONTROL CAPABILITY

(75) Inventor: Jan Veit, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 215 days.

(21) Appl. No.: 13/045,800

(22) Filed: Mar. 11, 2011

(65) Prior Publication Data

US 2012/0227823 A1 Sep. 13, 2012

(51) Int. Cl.
*E21B 34/00* (2006.01)

(52) U.S. Cl. ..... 166/325; 166/329; 137/528

(58) Field of Classification Search ..... 166/318, 166/325, 329; 137/528
See application file for complete search history.

(56) References Cited

U.S. PATENT DOCUMENTS

| | | | | |
|---|---|---|---|---|
| 148,387 | A | 3/1874 | Squires | |
| 1,536,348 | A | 5/1925 | Mack | |
| 2,517,841 | A | 8/1950 | Chenault | |
| 2,602,516 | A | 7/1952 | Gray | |
| 4,360,063 | A * | 11/1982 | Kilgore | 166/317 |
| 4,423,773 | A * | 1/1984 | Stout | 166/51 |
| 4,729,432 | A * | 3/1988 | Helms | 166/317 |
| 4,828,037 | A * | 5/1989 | Lindsey et al. | 166/382 |
| 5,320,178 | A | 6/1994 | Cornette | |
| 5,337,808 | A | 8/1994 | Graham | |
| 5,435,393 | A | 7/1995 | Brekke et al. | |
| 5,803,179 | A | 9/1998 | Echols et al. | |
| 5,812,331 | A | 9/1998 | Lopez et al. | |
| 5,896,928 | A | 4/1999 | Coon | |
| 6,112,815 | A | 9/2000 | Boe et al. | |
| 6,112,817 | A | 9/2000 | Voll et al. | |
| 6,343,651 | B1 | 2/2002 | Bixenman | |
| 6,371,210 | B1 | 4/2002 | Bode et al. | |
| 6,470,749 | B1 | 10/2002 | Han et al. | |
| 6,547,007 | B2 * | 4/2003 | Szarka et al. | 166/317 |
| 6,622,794 | B2 | 9/2003 | Zisk, Jr. | |

(Continued)

FOREIGN PATENT DOCUMENTS

| | | |
|---|---|---|
| GB | 2421746 | 7/2006 |
| GB | 2455001 | 5/2009 |

(Continued)

OTHER PUBLICATIONS

ISWRO, PCT/US2012/026041, KIPO (Sep. 14, 2012).

(Continued)

*Primary Examiner* — William McCalister
(74) *Attorney, Agent, or Firm* — Lawrence R. Youst

(57) ABSTRACT

A flow control screen having a fluid flow path between the interior of a base pipe and a filter medium. A valve assembly, including a piston body, a valve plug and a ball retainer having an opening, is disposed within the fluid flow path. The piston body has an internal seat and a collet assembly that is radially outwardly constrained by the ball retainer in a first operating position to retain the valve plug therein and radially outwardly unconstrained by the ball retainer in a second operating position. Reverse flow is initially prevented as internal differential pressure seats the valve plug on the internal seat and causes the piston body to shift to the second operating position upon reaching a predetermined threshold. Thereafter, external differential pressure causes the valve plug to be expelled from the valve assembly through the opening of the ball retainer, thereby no longer preventing reverse flow.

14 Claims, 7 Drawing Sheets

U.S. PATENT DOCUMENTS

| | | | | |
|---|---|---|---|---|
| 6,644,412 | B2 | 11/2003 | Bode et al. | |
| 6,719,051 | B2 | 4/2004 | Hailey, Jr. et al. | |
| 6,786,285 | B2 | 9/2004 | Johnson et al. | |
| 6,857,476 | B2 | 2/2005 | Richards | |
| 6,883,613 | B2 | 4/2005 | Bode et al. | |
| 6,886,634 | B2 | 5/2005 | Richards | |
| 6,899,176 | B2 | 5/2005 | Hailey, Jr. et al. | |
| 6,978,840 | B2 | 12/2005 | Henderson | |
| 7,055,598 | B2 | 6/2006 | Ross et al. | |
| 7,096,945 | B2 | 8/2006 | Richards et al. | |
| 7,100,686 | B2 | 9/2006 | Wittrisch | |
| 7,152,688 | B2 | 12/2006 | Richards | |
| 7,185,706 | B2 | 3/2007 | Freyer | |
| 7,191,833 | B2 | 3/2007 | Richards | |
| 7,204,316 | B2 | 4/2007 | Dusterhoft et al. | |
| 7,252,153 | B2 | 8/2007 | Hejl et al. | |
| 7,413,022 | B2 | 8/2008 | Broome et al. | |
| 7,426,962 | B2 | 9/2008 | Moen et al. | |
| 7,451,815 | B2 | 11/2008 | Hailey et al. | |
| 7,469,743 | B2 | 12/2008 | Richards | |
| 7,537,056 | B2 | 5/2009 | MacDougall | |
| 7,708,068 | B2 | 5/2010 | Hailey, Jr. | |
| 7,775,283 | B2 | 8/2010 | Coronado et al. | |
| 7,775,284 | B2 | 8/2010 | Richards et al. | |
| 7,789,145 | B2 | 9/2010 | Patel | |
| 7,802,621 | B2 | 9/2010 | Richards et al. | |
| 7,841,398 | B2 | 11/2010 | Tibbles et al. | |
| 7,891,420 | B2 | 2/2011 | Dale et al. | |
| 7,918,275 | B2 | 4/2011 | Clem | |
| 7,926,571 | B2 * | 4/2011 | Hofman | 166/373 |
| 7,980,313 | B2 * | 7/2011 | Barbee, Jr. | 166/325 |
| 8,181,701 | B2 * | 5/2012 | Yokley et al. | 166/194 |
| 8,215,401 | B2 * | 7/2012 | Braekke et al. | 166/318 |
| 8,245,788 | B2 * | 8/2012 | Garcia et al. | 166/373 |
| 8,256,522 | B2 * | 9/2012 | Veit et al. | 166/386 |
| 8,291,988 | B2 * | 10/2012 | King | 166/387 |
| 2006/0186601 | A1 | 8/2006 | Lopez | |
| 2007/0012444 | A1 | 1/2007 | Horgan et al. | |
| 2008/0035330 | A1 | 2/2008 | Richards | |
| 2008/0041580 | A1 | 2/2008 | Freyer et al. | |
| 2008/0041581 | A1 | 2/2008 | Richards | |
| 2008/0041588 | A1 | 2/2008 | Richards et al. | |
| 2008/0283238 | A1 | 11/2008 | Richards et al. | |
| 2009/0000787 | A1 | 1/2009 | Hill et al. | |
| 2009/0065199 | A1 | 3/2009 | Patel et al. | |
| 2009/0078428 | A1 | 3/2009 | Ali | |
| 2009/0084556 | A1 | 4/2009 | Richards et al. | |
| 2009/0133882 | A1 | 5/2009 | Delaloye et al. | |
| 2009/0151925 | A1 | 6/2009 | Richards et al. | |
| 2009/0277650 | A1 | 11/2009 | Casciaro et al. | |
| 2011/0198097 | A1 | 8/2011 | Moen | |

FOREIGN PATENT DOCUMENTS

| | | |
|---|---|---|
| WO | 02075110 | 9/2002 |
| WO | 2004018837 | 3/2004 |
| WO | 2009048822 | 4/2009 |
| WO | 2009048823 | 4/2009 |
| WO | 2009065793 | 5/2009 |
| WO | 2009065890 | 5/2009 |
| WO | 2009066097 | 5/2009 |
| WO | 2009067021 | 5/2009 |

OTHER PUBLICATIONS

Martin P. Coronado, Next Generation Sand Screen Enables Drill-in Sandface Completions, Offshore (Dec. 2009), pp. 54-56.

* cited by examiner

FLOW CONTROL SCREEN ASSEMBLY HAVING REMOTELY DISABLED REVERSE FLOW CONTROL CAPABILITY

TECHNICAL FIELD OF THE INVENTION

This invention relates, in general, to equipment utilized in conjunction with operations performed in subterranean wells and, in particular, to a flow control screen assembly that is operable to control the inflow of formation fluids and selectively operable to prevent reverse flow of fluids into the formation.

BACKGROUND OF THE INVENTION

Without limiting the scope of the present invention, its background will be described with reference to fluid production from a hydrocarbon bearing subterranean formation, as an example.

During the completion of a well that traverses a hydrocarbon bearing subterranean formation, production tubing and various completion equipment are installed in the well to enable safe and efficient production of the formation fluids. For example, to prevent the production of particulate material from an unconsolidated or loosely consolidated subterranean formation, certain completions include one or more sand control screens positioned proximate the desired production intervals. In other completions, to control the flow rate of production fluids into the production tubing, it is common practice to install one or more flow control devices within the tubing string.

Attempts have been made to utilize fluid flow control devices within completions requiring sand control. For example, in certain sand control screens, after production fluids flows through the filter medium, the fluids are directed into a flow control section. The flow control section may include one or more flow restrictors such as flow tubes, nozzles, labyrinths or the like. Typically, the production rate through these flow control screens is fixed prior to installation by individually adjusting the flow restrictors of the flow control screens.

It has been found, however, that the during the completion process, it may be desirable to pressure up the completion string to operate or set certain tools, such as packers. Current flow control screens require the running of a separate work string into the completion string to achieve this result or require that one or more permanent check valves be incorporated into each of the flow control screens. In addition, it has been found, that it may desirable to allow reverse flow from the completion string into the formation in certain completions requiring fluid flow control, sand control and tools setting capabilities.

Accordingly, a need has arisen for a flow control screen that is operable to control the inflow of formation fluids in a completion requiring sand control. A need has also arisen for such a flow control screen that is operable to be pressured up during the completion process. Further, a need has arisen for such a flow control screen that is operable to selectively allow reverse flow from the completion string into the formation.

SUMMARY OF THE INVENTION

The present invention disclosed herein comprises a flow control screen for controlling the inflow of formation fluids in completions requiring sand control. In addition, the flow control screen of the present invention is operable to be pressured up during the completion process. Further, the flow control screen of the present invention is operable to selectively allow reverse flow from the completion string into the formation.

In one aspect, the present invention is directed to a flow control screen having a fluid flow path between an interior of a base pipe and a filter medium. The flow control screen includes a valve assembly disposed within the fluid flow path. The valve assembly includes a piston body, a valve plug and a ball retainer having an opening. The piston body has an internal seat and a collet assembly that is radially outwardly constrained by the ball retainer in a first operating position to retain the valve plug in the piston body and radially outwardly unconstrained by the ball retainer in a second operating position. In operation, an internal differential pressure seats the valve plug on the internal seat to prevent reverse flow, a predetermined internal differential pressure on the valve plug causes the piston body to shift from the first operating position to the second operating position while continuing to prevent reverse flow and, in the second operating position, an external differential pressure causes the valve plug to be expelled from the valve assembly through the opening of the ball retainer, thereby no longer preventing reverse flow.

In one embodiment, at least a portion of the collet assembly is slidably positioned within the ball retainer in the first operating position. In this embodiment, operation of the piston assembly from the first operating position to the second operation position is prevented by a retainer pin until the predetermined internal differential pressure acts on the valve plug. In another embodiment, the valve plug is a spherical blocking member. In certain embodiments, the collet assembly has a plurality of collet fingers having radially inwardly projecting lips, radially outwardly projecting lips or both.

In one embodiment, the valve assembly includes a reentry barrier operably associated with the ball retainer to prevent reentry of the valve plug into the valve assembly. In certain embodiments, the reentry barrier is in the form of a c-ring positioned around the ball retainer. In some embodiments, the reentry barrier at least partially extends into the opening of the ball retainer. In other embodiments, the reentry barrier resists exit of the valve plug from the valve assembly.

In another aspect, the present invention is directed to a flow control screen having a fluid flow path between an interior of a base pipe and a filter medium. The flow control screen includes a plurality of circumferentially distributed valve assemblies disposed within the fluid flow path. Each valve assembly includes a piston body, a valve plug and a ball retainer having an opening. The piston body has an internal seat and a collet assembly that is radially outwardly constrained by the ball retainer in a first operating position to retain the valve plugs in the piston body and radially outwardly unconstrained by the ball retainer in a second operating position. In operation, an internal differential pressure seats the valve plugs on the internal seats to prevent reverse flow, a predetermined internal differential pressure on the valve plugs causes the piston bodies to shift from the first operating position to the second operating position while continuing to prevent reverse flow and, in the second operating position, an external differential pressure causes the valve plugs to be expelled from the valve assemblies through the openings of the ball retainers, thereby no longer preventing reverse flow.

In a further aspect, the present invention is directed to a method for operating a flow control screen. The method includes disposing at least one valve assembly within a fluid flow path between an interior of a base pipe and a filter medium, retaining a valve plug within a piston body of the valve assembly by radially outwardly constraining a collet assembly in a first operating position of the piston body with a ball retainer, applying an internal differential pressure to seat the valve plug on an internal seat of the piston body to prevent reverse flow, applying a predetermined internal differential pressure on the valve plug to shift the piston body from the first operating position to a second operating position while continuing to prevent reverse flow and applying an external differential pressure to expel the valve plug from the valve assembly through an opening in the ball retainer, thereby no longer preventing reverse flow. The method may also include preventing reentry of the valve plug into the valve assembly with a reentry barrier disposed around the ball retainer and extending at least partially into the opening.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
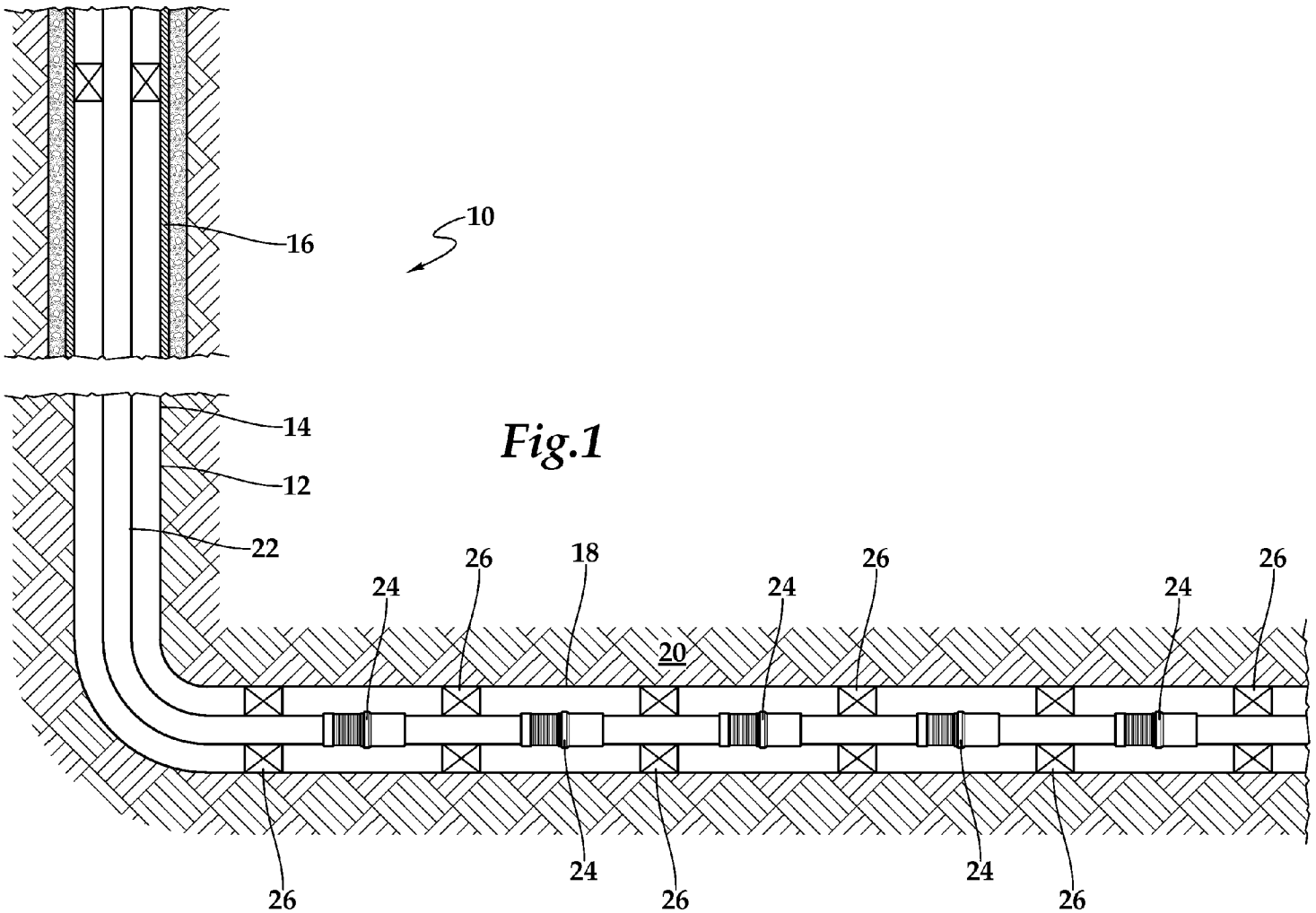
FIG. 1 is a schematic illustration of a well system operating a plurality of flow control screens according to an embodiment of the present invention.

Referring initially to FIG. 1, therein is depicted a well system including a plurality of flow control screens embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and injection fluids to travel from the surface to formation 20. At its lower end, tubing string 22 is coupled to a completions string that has been installed in wellbore 12 and divides the completion interval into various production intervals adjacent to formation 20. The completion string includes a plurality of flow control screens 24, each of which is positioned between a pair of packers 26 that provides a fluid seal between the completion string and wellbore 12, thereby defining the production intervals.

Flow control screens 24 serve the primary functions of filtering particulate matter out of the production fluid stream and controlling the flow rate of the production fluid stream. In addition, as discussed in greater detail below, flow control screens 24 are operable to be pressured up during installation of the completion string. For example, when the completion string is positioned in the desired location in wellbore 12, internal pressure may be used to set packers 26 to divide the completion interval into the desired number of production intervals. During this setting process, flow control screens 24 are in their running configuration in which they are operable to hold pressure for repeated cycles as long as the pressure remains below a predetermined threshold pressure. Once all pressure operated completion components are set or during the setting of the final pressure operated completion component, the internal pressure may be raised above the predetermined threshold pressure to operate flow control screens 24 into their sheared configuration. In this configuration, flow control screens continue to hold pressure, however, when the internal pressure is released and the differential pressure across flow control screens 24 is positive between the outside and inside of flow control screens 24, flow control screens 24 are operated to their production configuration.

Even though FIG. 1 depicts the flow control screens of the present invention in an open hole environment, it should be understood by those skilled in the art that the flow control screens of the present invention are equally well suited for use in cased wells. Also, even though FIG. 1 depicts one flow control screen in each production interval, it should be understood by those skilled in the art that any number of flow control screens of the present invention may be deployed within a production interval without departing from the principles of the present invention. In addition, even though FIG. 1 depicts the flow control screens of the present invention in a horizontal section of the wellbore, it should be understood by those skilled in the art that the flow control screens of the present invention are equally well suited for use in well having other directional configurations including vertical wells, deviated well, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2A:
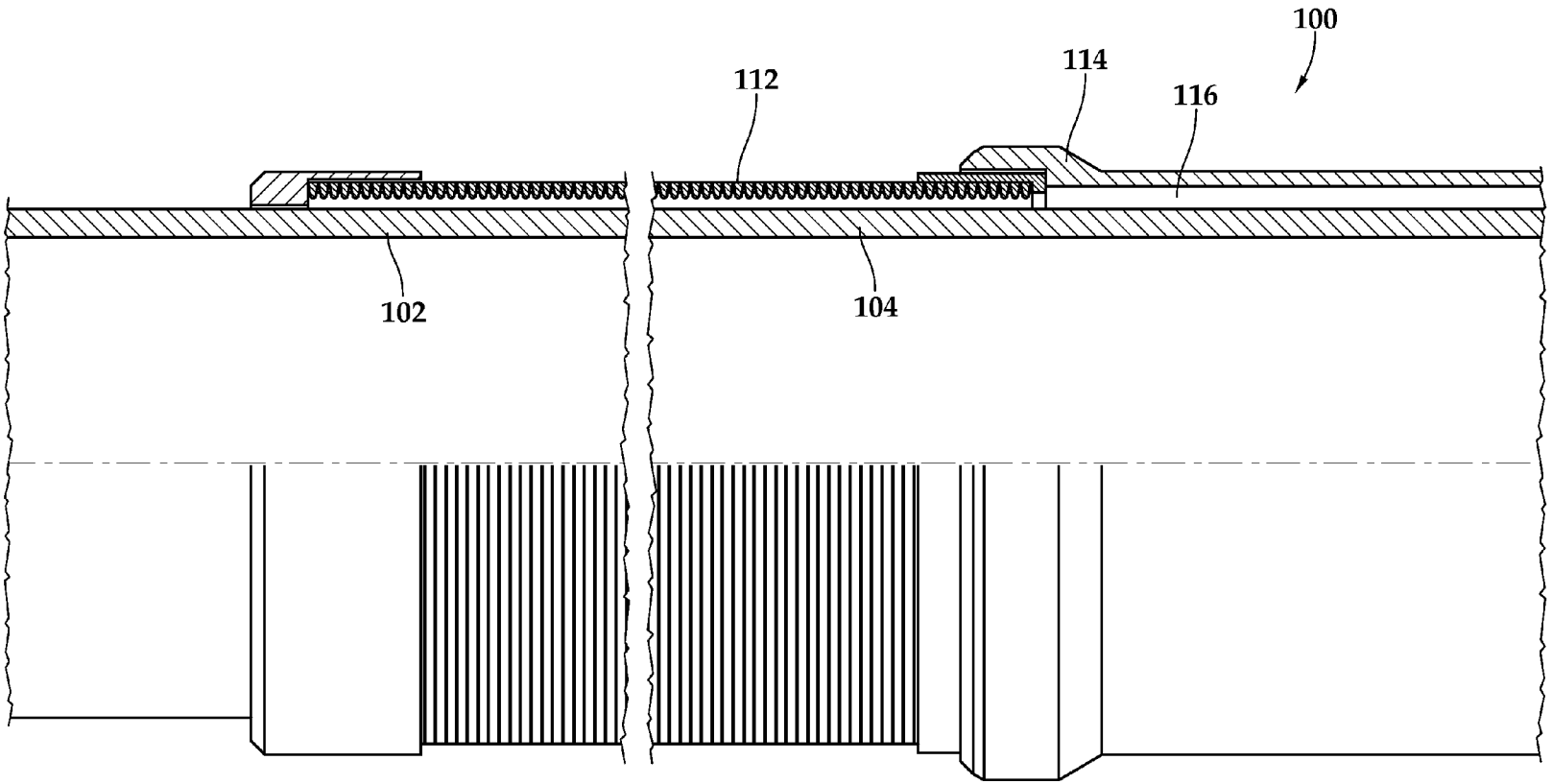
FIGS. 2A-2C are quarter sectional views of successive axial sections of a flow control screen according to an embodiment of the present invention.
Figure 2B:
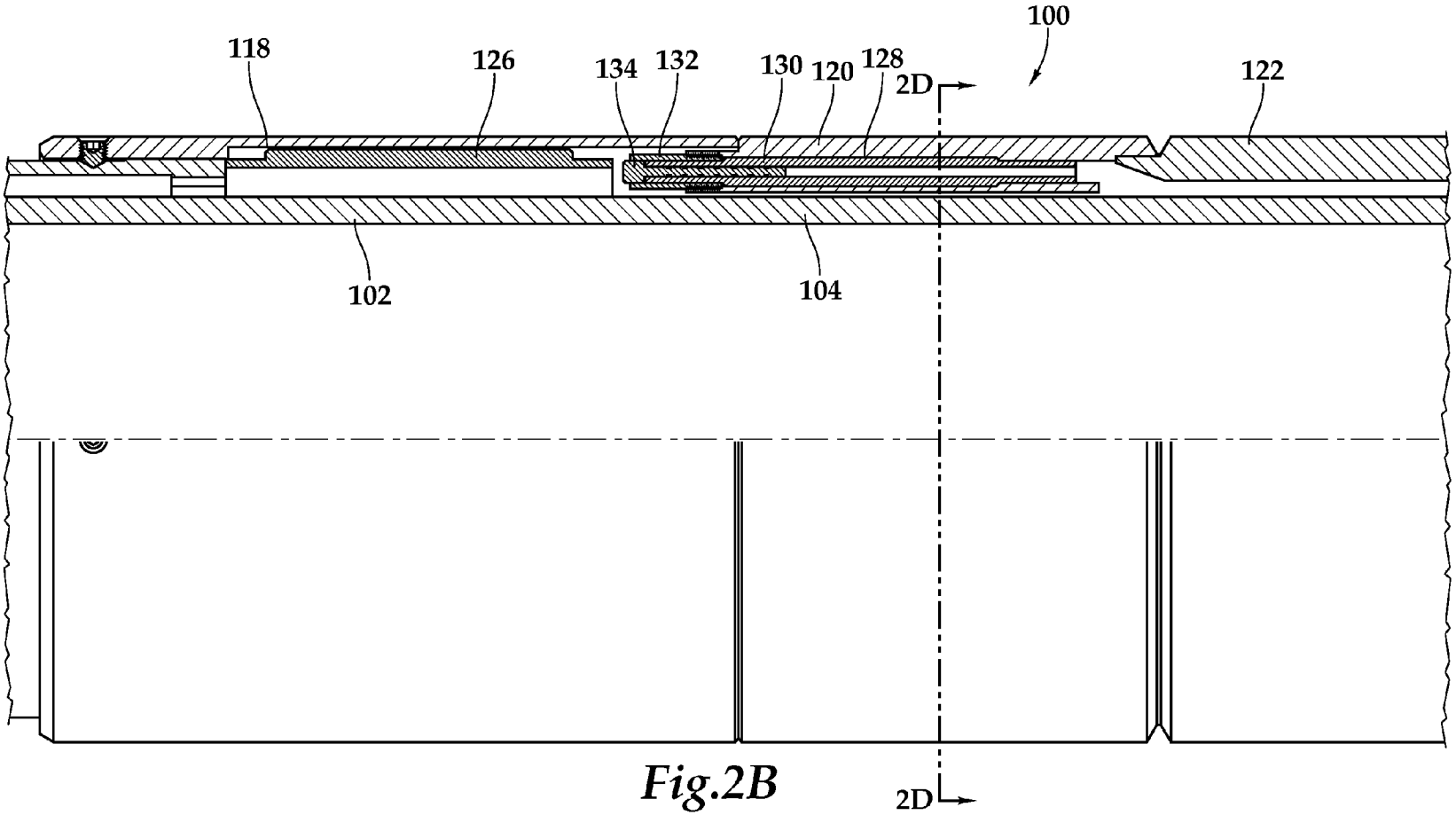
Figure 2C:
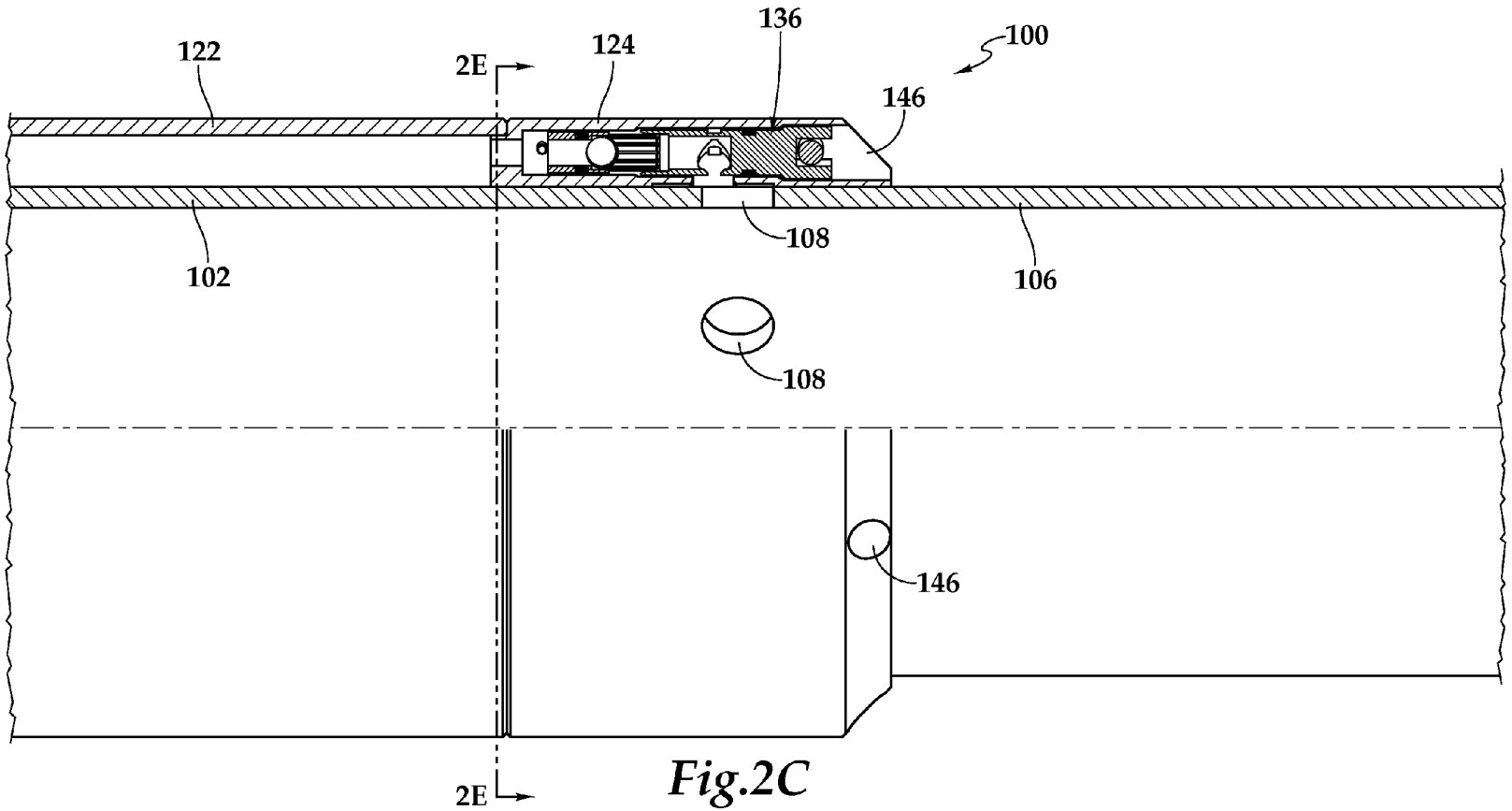

Referring next to FIGS. 2A-2C, therein is depicted successive axial sections of a flow control screen according to the present invention that is representatively illustrated and generally designated 100. Flow control screen 100 may be suitably coupled to other similar flow control screens, production packers, locating nipples, production tubulars or other downhole tools to form a completions string as described above. Flow control screen 100 includes a base pipe 102 that has a blank pipe section 104 and a perforated section 106 including a plurality of production ports 108. Positioned around an uphole portion of blank pipe section 104 is a screen element or filter medium 112, such as a wire wrap screen, a woven wire mesh screen, a prepacked screen or the like, designed to allow fluids to flow therethrough but prevent particulate matter of a predetermined size from flowing therethrough. Positioned downhole of filter medium 112 is a screen interface housing 114 that forms an annulus 116 with base pipe 102. Securably connected to the downhole end of screen interface housing 114 is a sleeve housing 118. At its downhole end, sleeve housing 118 is securably connected to a flow tube housing 120 which is securably connected to the uphole end of an intermediate housing 122. In addition, flow tube housing 120 is preferably securably connected or sealably coupled to base pipe 102 to prevent fluid flow therebetween. Toward its downhole end, intermediate housing 122 is securably connected to a valve assembly housing 124 which is preferably welded to base pipe 102 at its downhole end. The various connections of the housing sections may be made in any suitable fashion including welding, threading and the like as well as through the use of fasteners such as pins, set screws and the like. Together, the housing sections create a generally annular fluid flow path between filter medium 112 and perforated section 106 of base pipe 102.

Figure 2D:
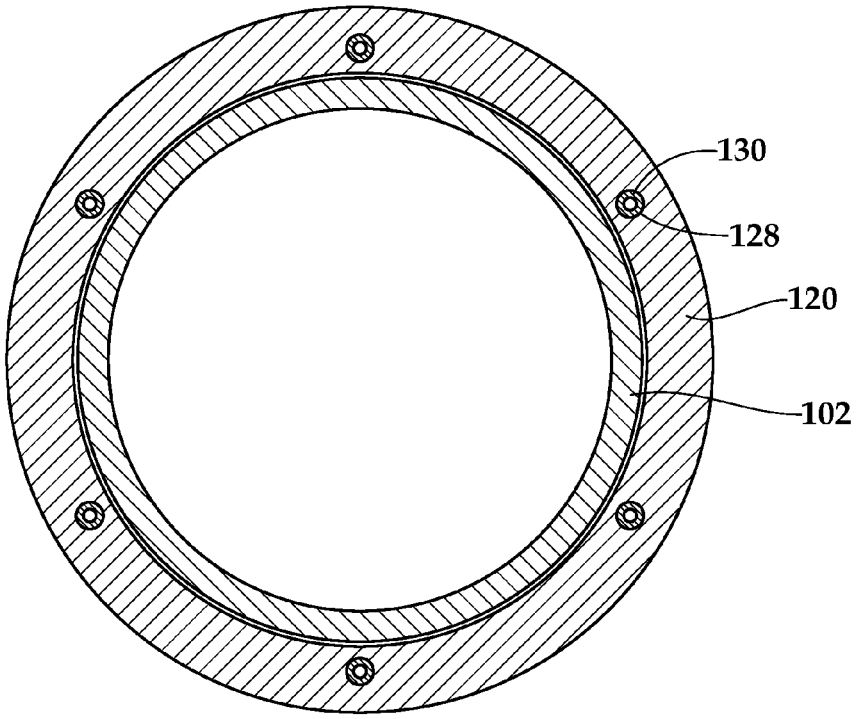
FIG. 2D is a cross sectional view of the flow control screen of FIG. 2B taken along line 2D-2D.

Positioned in the annular region between housing sleeve 118 and base pipe 102 is a split ring spacer 126. Positioned within a plurality of axial openings 128 in flow tube housing 120 are flow tubes 130 that form a fluid flow control section of flow control screen 100. As best seen in FIG. 2D, the illustrated embodiment includes six axial openings 128 and six flow tubes 130, however, those skilled in the art will recognize that other numbers of flow tubes both greater than and less than six could alternatively be used and would be considered within the scope of the present invention. Each of the flow tubes 130 is secured within flow tube housing 120 by a threaded retaining sleeve 132. One or more of the flow tube 130 may have a threaded cap or a plug 134 associated therewith to inhibit or stop flow therethrough. The use of plugs 134 and flow tubes 130 having various inner lengths and diameters allow an operator to adjust the pressure drop rating of each flow control screen 100 to a desired level such that a completion string including a plurality of flow control screens 100 is operable to counteract heel-toe effects in long horizontal completions, balance inflow in highly deviated and fractured wells, reduce annular sand transportation and reduce water/gas influx, thereby lengthening the productive life of the well.

Figure 2E:
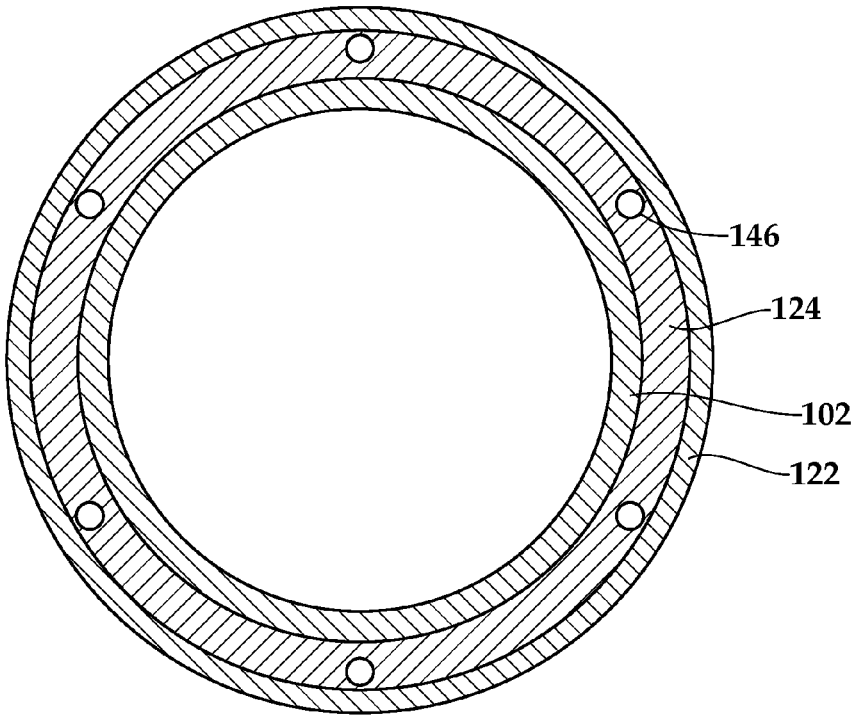
FIG. 2E is a cross sectional view of the flow control screen of FIG. 2C taken along line 2E-2E.

Positioned within a plurality of axial openings 146 in valve assembly housing 124 are valve assemblies 136 that form a reverse fluid flow control section of flow control screen 100. As best seen in FIG. 2E, the illustrated embodiment includes six axial openings 146 for six valve assemblies 136, however, those skilled in the art will recognize that other numbers of valve assemblies both greater than and less than six could alternatively be used and would be considered within the scope of the present invention.

Figure 5:
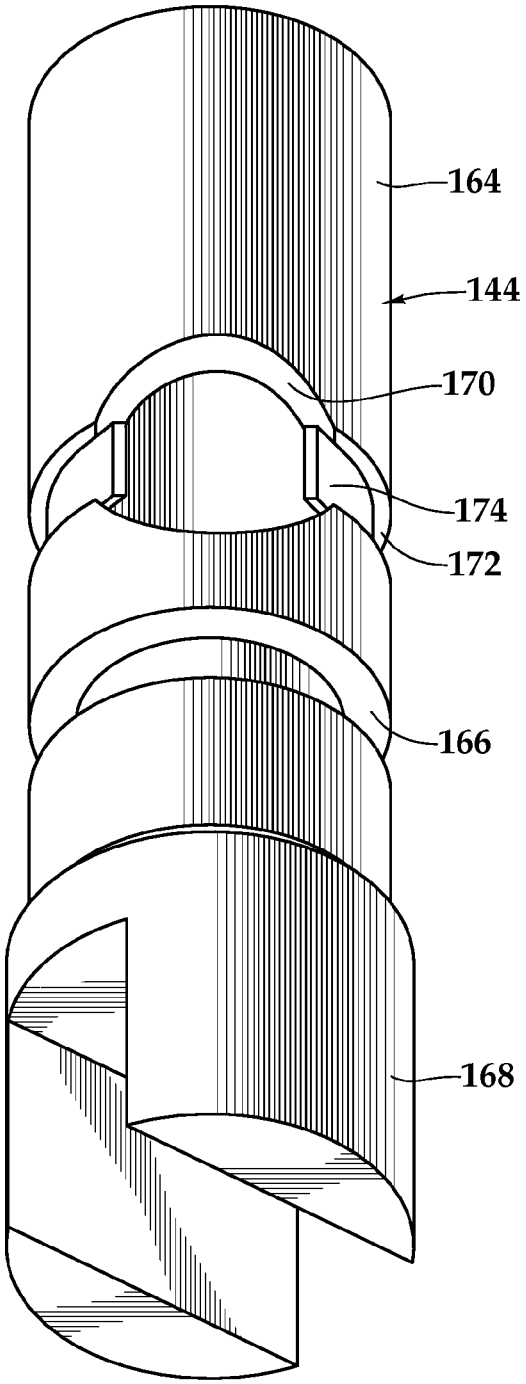
FIG. 5 is an isometric view of a ball retainer having a reentry barrier of a valve assembly that is operable for use in a flow control screen according to an embodiment of the present invention.

As best seen in FIGS. 3A-3D, each valve assembly 136 includes a piston assembly 138, a valve plug 140, a retainer pin 142 and a ball retainer 144. Piston assembly 138 includes a piston body 148 having an o-ring groove 150, as best seen in FIG. 5. Integrally extending from piston body 148 is a plurality of collet fingers 154 forming a collet assembly 156. At the distal ends thereof, each collet finger 154 includes a lip 158. In the illustrated embodiment, lip 158 include a radially inwardly portion and a radially outwardly portion. As explained in greater detail below, collet fingers 154 of collet assembly 156 are radially outwardly constrained in a first operating position of piston body 148 to retain valve plug 140 within piston body 148 and radially outwardly unconstrained in a second operating position of piston body 148.

Figure 3A:
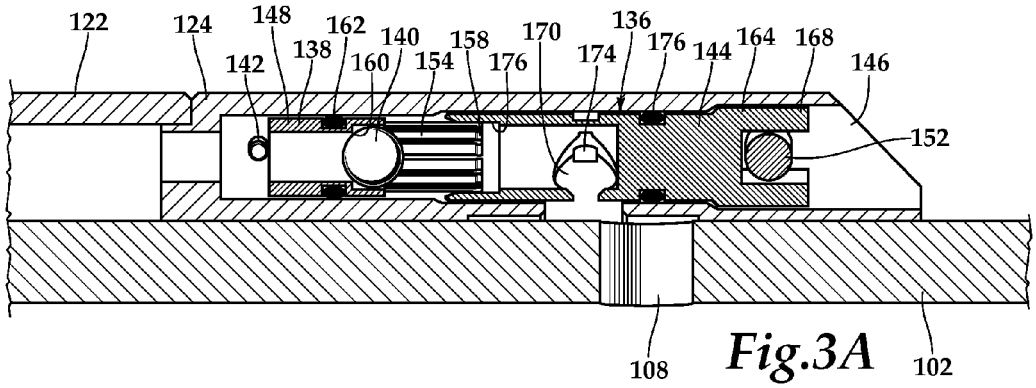
FIGS. 3A-3D are cross sectional views of a valve assembly in its various operating configurations that is operable for use in a flow control screen according to an embodiment of the present invention.

Valve plugs 140 are depicted as spherical blocking members and are initially allowed to move within piston body 148 between shoulder 160 and lips 158, as best seen in FIG. 3A. Those skilled in the art will recognize, however, that even though valve plugs 140 are depicted as spherical in shape, valve plugs 140 could have alternate shapes including cylindrical configurations, substantially cylindrical configurations or other configurations so long as valve plugs 140 are capable of creating a seal within piston body 148 and of being ejected from piston body 148, as described below. As illustrated, uphole travel of each valve plug 140 is limited by shoulder 160 and downhole travel of valve plug 140 is limited by lips 158 as radially outward movement of collet fingers 154 is disallowed by ball retainer 144. Each valve assembly 136 is retained within one of the axial openings 146 by a retainer pin 142 and a retainer pin 152. Axial movement of piston assembly 138 is initially prevented by retainer pin 142. A seal, depicted as o-ring 162, prevents fluid travel around piston assembly 138 through opening 146.

Ball retainer 144 includes a ball retainer body 164 having an o-ring groove 166, a pin receiver 168, a ball discharge opening 170, a reentry barrier groove 172 having a reentry barrier 174 disposed therein, as best seen in FIG. 5. Ball retainer body 164 has an inner diameter 176 that is sized to receive collet fingers 154 therein such that collet fingers 154 are radially outwardly constrained to retain valve plug 140 within piston body 148, as best seen in FIG. 3A. Inner diameter 176 is also sized to receive valve plug 140 therein during certain operating modes of valve assembly 136. Ball discharge opening 170 is sized to allow the passages of valve plug 140 therethrough. Reentry barrier 174, depicted as a c-ring that extends around reentry barrier groove 172 of ball retainer body 164 and at least partially into ball discharge opening 170, resists the movement of valve plug 140 from inside ball retainer body 164 to outside of ball retainer body 164 and prevents movement of valve plug 140 from outside ball retainer body 164 to inside of ball retainer body 164. As illustrated, pin 152 is received within pin receiver 168 to prevent axial movement of ball retainer body 164. A seal, depicted as o-ring 176, prevents fluid travel around ball retainer body 164 through opening 146.

FIG. 3A represents the running configuration of flow control screen 100 in which valve assemblies 136 are secured within valve assembly housing 124 and valve plugs 140 are disposed within piston bodies 148. In this configuration, an internal differential pressure, wherein the pressure inside of base pipe 102 is greater than the pressure outside of base pipe 102, may be applied to the tubular string deploying flow control screens 100. Specifically, the internal differential pressure will travel through production ports 108 but reverse flow through flow control screens 100 is prevented by valve assemblies 136 as valve plugs 140 seat on shoulders 160, as best seen in FIG. 3A. Repeated pressure cycles may be applied to the tubular as long as the pressure remains below the shear pressure of retainer pins 142.

Figure 3B:
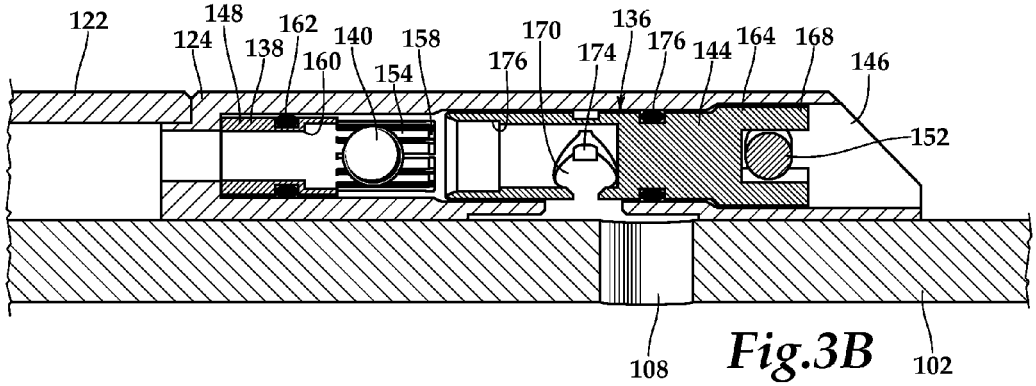
Figure 3C:
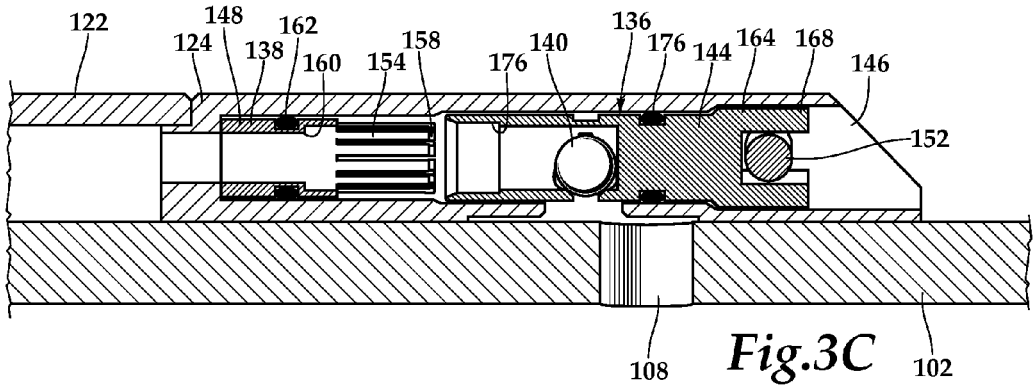
Figure 3D:
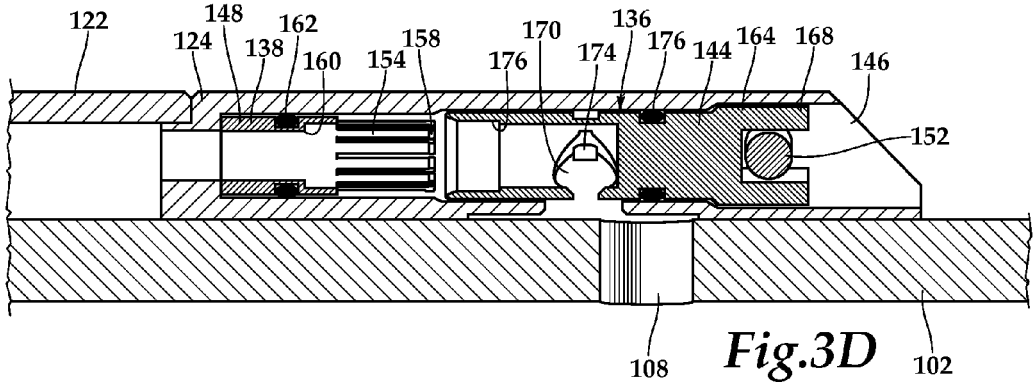
Figure 4:
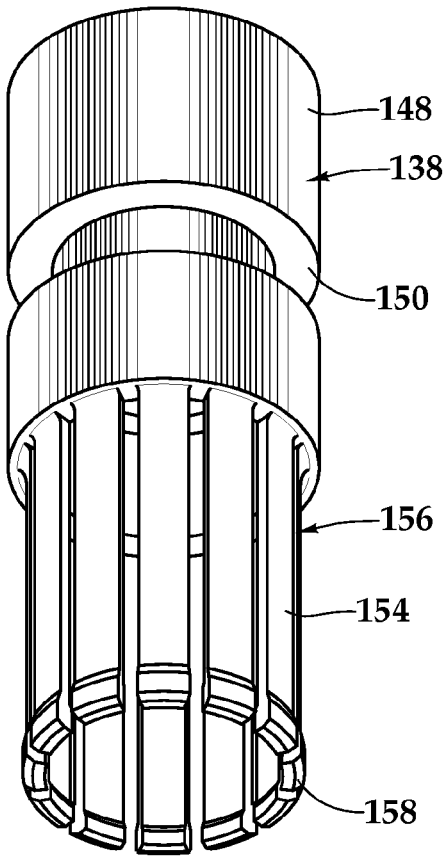
FIG. 4 is an isometric view of a piston assembly of a valve assembly that is operable for use in a flow control screen according to an embodiment of the present invention.

When it is desired to operate flow control screens 100 from the running configuration to the sheared configuration, the internal differential pressure may be raised to a predetermined threshold pressure above the shear pressure of retainer pins 142 causing retainer pins 142 to shear and piston assemblies 138 have shifted to the left, as best seen in FIG. 3B. In this configuration, valve assemblies 136 continue to hold pressure and prevent reverse fluid flow through flow control screens 100 from production ports 108 to filter medium 112. Once the internal differential pressure is released and an external differential pressure, wherein the pressure outside base pipe 102 is greater than the pressure inside base pipe 102, is applied to flow control screens 100, valve plugs 140 are expelled from piston assemblies 138 as radially outward movement of collet fingers 154 is no longer disallowed by ball retainer, as best seen in FIG. 3C. Once expelled, valve plugs 140 enters an annular region inside of valve assembly housing 124 via ball discharge opening 170 passing through reentry barrier 174 which resists but does not prevent the movement of valve plug 140 from inside ball retainer body 164 to outside of ball retainer body 164, as best seen in FIG. 3D. Once discharged, reentry of a valve plug 140 into a valve assembly 136 is disallowed by reentry barriers 174, such that valve assemblies 136 no longer prevent reverse fluid flow placing flow control screens 100 in their production configuration.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A flow control screen having a fluid flow path between an interior of a base pipe and a filter medium, the flow control screen comprising:

a valve assembly disposed within the fluid flow path including a piston body, a valve plug and a ball retainer having an opening, the piston body having an internal seat and a collet assembly that is radially outwardly constrained by the ball retainer in a first operating position to retain the valve plug in the piston body and radially outwardly unconstrained by the ball retainer in a second operating position; and a c-ring positioned around the ball retainer operable to prevent reentry of the valve plug into the valve assembly, wherein an internal differential pressure seats the valve plug on the internal seat to prevent reverse flow;

wherein a predetermined internal differential pressure on the valve plug causes the piston body to shift from the first operating position to the second operating position while continuing to prevent reverse flow; and wherein, in the second operating position, an external differential pressure causes the valve plug to be expelled from the valve assembly through the opening of the ball retainer, thereby no longer preventing reverse flow.

2. The flow control screen as recited in claim 1 wherein at least a portion of the collet assembly is slidably positioned within the ball retainer in the first operating position.

3. The flow control screen as recited in claim 1 wherein operation of the piston assembly from the first operating position to the second operation position is prevented by a retainer pin until the predetermined internal differential pressure acts on the valve plug.

4. The flow control screen as recited in claim 1 wherein the valve plug further comprises a spherical blocking member.

5. The flow control screen as recited in claim 1 wherein the collet assembly further comprises a plurality of collet fingers having radially inwardly projecting lips.

6. The flow control screen as recited in claim 1 wherein the collet assembly further comprises a plurality of collet fingers having radially outwardly projecting lips.

7. The flow control screen as recited in claim 1 wherein the collet assembly further comprises a plurality of collet fingers having radially inwardly and outwardly projecting lips.

8. The flow control screen as recited in claim 1 wherein the c-ring at least partially extends into the opening of the ball retainer.

9. The flow control screen as recited in claim 1 wherein the c-ring resists exit of the valve plug from the valve assembly.

10. A flow control screen having a fluid flow path between an interior of a base pipe and a filter medium, the flow control screen comprising:

a plurality of circumferentially distributed valve assemblies disposed within the fluid flow path, each valve assembly including a piston body, a valve plug and a ball retainer having an opening, the piston body having an internal seat and a collet assembly that is radially outwardly constrained by the ball retainer in a first operating position to retain the valve plugs in the piston body and radially outwardly unconstrained by the ball retainer in a second operating position; and a c-ring positioned around each of the ball retainers, the c-rings operable to prevent reentry of the valve plugs into the valve assemblies, wherein an internal differential pressure seats the valve plugs on the internal seats to prevent reverse flow;

wherein a predetermined internal differential pressure on the valve plugs causes the piston bodies to shift from the first operating position to the second operating position while continuing to prevent reverse flow; and wherein, in the second operating position, an external differential pressure causes the valve plugs to be expelled from the valve assemblies through the openings of the ball retainers, thereby no longer preventing reverse flow.

11. The flow control screen as recited in claim 10 wherein operation of each piston body from the first operating position to the second operation position is prevented by a retainer pin until the predetermined internal differential pressure acts on the valve plug.

12. The flow control screen as recited in claim 10 wherein the valve plugs further comprise spherical blocking members.

13. The flow control screen as recited in claim 10 wherein the c-rings at least partially extend into the openings of the ball retainers.

14. The flow control screen as recited in claim 10 wherein the c-rings resist exit of the valve plugs from the valve assemblies.

* * * * *